US006053762A

United States Patent [19]

Matsumura et al.

[11] Patent Number: 6,053,762

[45] **Date of Patent: *Apr. 25, 2000**

[54] SERVICE PLUG TERMINAL FITTING STRUCTURE

[75] Inventors: Mizuko Matsumura; Hidehiko Kuboshima, both of Shizuoka, Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/923,418

[22] Filed: Sep. 4, 1997

[30] Foreign Application Priority Data

Sep. 18, 1996 [JP] Japan ..... 8-246497

[51] Int. Cl.[7] ..... H01R 13/00

[52] U.S. Cl. ..... 439/484; 439/509

[58] Field of Search ..... 439/188, 484, 439/509, 511, 911; 200/51 R

[56] References Cited

U.S. PATENT DOCUMENTS

| | | | |
|---|---|---|---|
| 2,507,092 | 5/1950 | Cline | 439/484 |
| 5,195,897 | 3/1993 | Kent et al. | 439/484 X |
| 5,454,731 | 10/1995 | Dickie | 439/484 |
| 5,609,493 | 3/1997 | Cheng et al. | 439/157 |

*Primary Examiner*—Khiem Nguyen
*Attorney, Agent, or Firm*—Sughrue, Mion, Zinn, Macpeak & Seas, PLLC

[57] ABSTRACT

A terminal fitting structure of a service plug is provided with a plug body provided with short-circuiting terminals, a turning shaft provided to the plug body so that the turning shaft is perpendicular to the respective fitting centers of the short-circuiting terminals, and a lever coupled to the plug body via the turning shaft so that the lever can be turned.

8 Claims, 4 Drawing Sheets

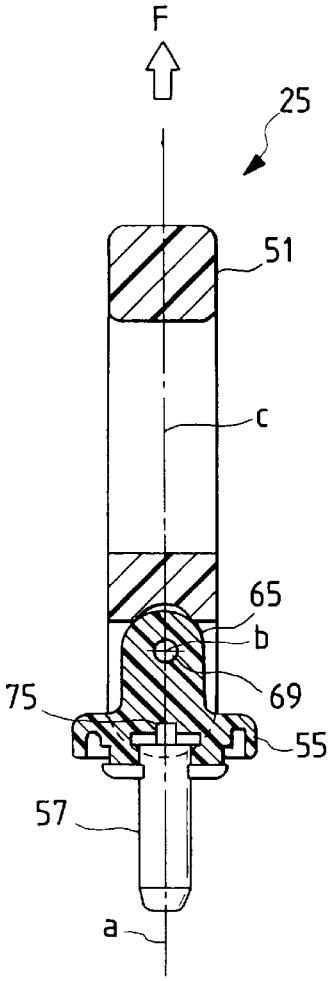
FIG. 1
FIG. 2
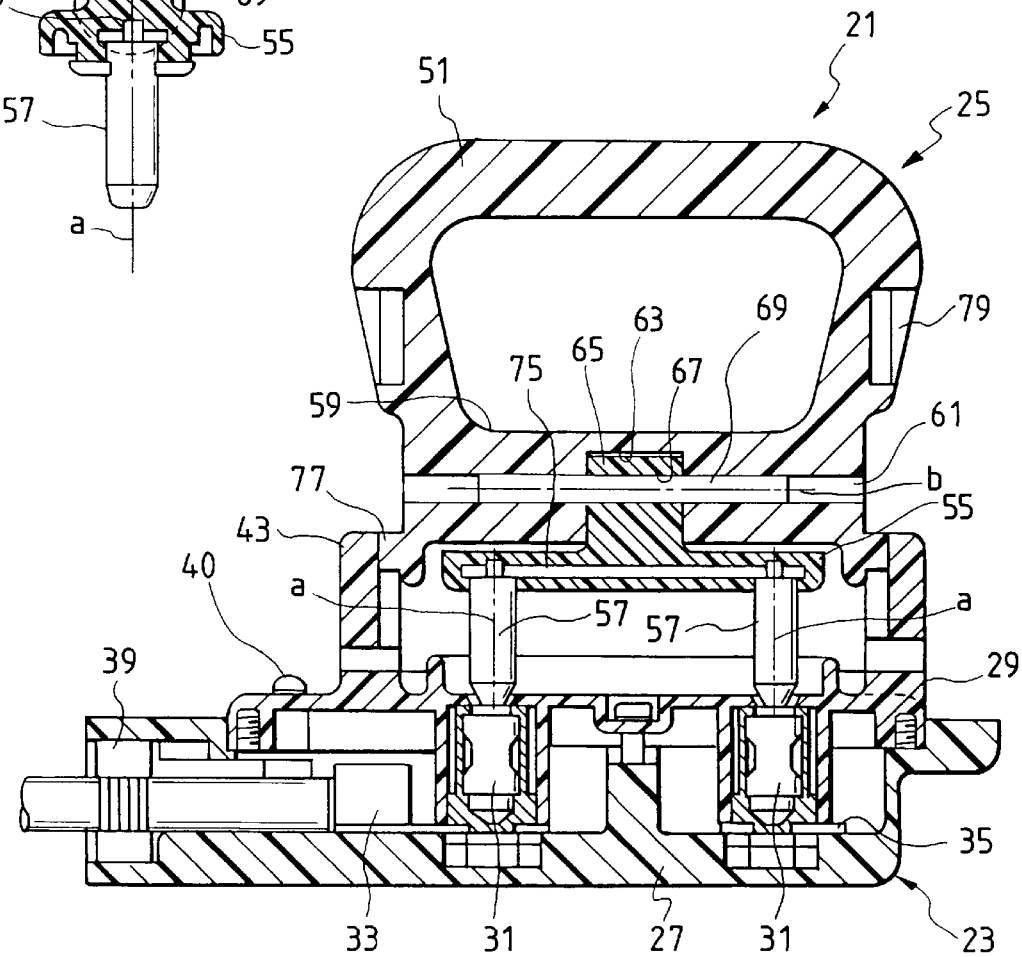

SERVICE PLUG TERMINAL FITTING STRUCTURE

BACKGROUND OF THE INVENTION

The present invention relates to the terminal fitting structure of a circuit switching device (service plug) for opening an electric circuit and cutting off the current of the circuit, and particularly to enhancing operability in attaching or detaching a plug body provided with short-circuiting terminals to/from circuit terminals.

In the switchboard of a high-voltage circuit and others, there is a circuit switching device used so that an operator is prevented from getting electric shock by detaching a plug provided to the switchboard from a terminal fixed in the body of the switchboard and cutting off the current of the circuit when the operator opens the cover of the switchboard.

Recently, attention is paid to an electric automobile as a pollution-free vehicle which does not exhaust exhaust gas. In the above electric automobile, since a high-voltage circuit for driving a motor is also provided, the current of the circuit is required to be cut off for the same reason as the above in maintenance service. At such a request, a circuit switching device (connector device) which is used in a conventional type electric automobile and automatically opens a high-voltage circuit stored inside a switchboard when the cover of the switchboard is opened, is disclosed in Japanese Patent Unexamined Publication No. Hei. 6-310227.

FIG. 6 is a perspective view showing a conventional connector and FIG. 7 is a sectional view showing a process in which the cover of the conventional connector is shut. A female connector 3 is fixed inside a box-shaped housing 1 the top which is open and can be connected to external high-voltage cables 5*a* and 5*b* via each connector terminal 6. A cover 7 for opening or closing an opening is provided to the housing 1 and is turned with a turning shaft 9 as the center. A guide 11 is provided to the cover 7 and holds a male connector 13 and a guide member 15 so that they can be moved in the direction perpendicular to the turning shaft 9. A spring 17 shown in FIG. 7 is arranged between the internal wall of the guide 11 and the male connector 13 and presses the male connector 13 and the guide member 15 in the direction in which they approach the turning shaft 9.

In a connector device 19 constituted as described above, when the cover 7 is shut, the male connector 13 approaches the female connector 3, drawing an arc-shaped locus with the turning shaft 9 as the center. The male connector 13 is moved in the direction in which it is parted from the turning shaft 9 against pressure by the spring 17 when the guide member 15 comes in contact with an internal wall 20*a* of a guide hole 20 in a process in which the male connector is fitted into the female connector 3, is again moved by pressure by the spring 17 in the direction in which the male connector approaches the turning shaft 9, is fitted in the female connector 3, absorbing dislocation caused by the arc-shaped locus in the fitting process, and electrifies the high-voltage cables 5*a* and 5*b*.

In the meantime, when the cover 7 is opened, the male connector 13 is detached from the female connector 3, being moved in the direction in which the male connector again approaches and is parted from the turning shaft 9, opens a high-voltage circuit between the high-voltage cables 5*a* and 5*b*, and as a result, can automatically cut off the current of the circuit.

However, in the above conventional connector, since the male connector 13 is provided on the cover 7, the male connector 13 is detached or fitted from/in the female connector 3 by opening or shutting the cover 7, and a high-voltage circuit is automatically opened or closed, if the cover is shut by mistake during maintenance, the high-voltage circuit is closed, the current of the circuit flows, and an operator may get electric shock. Therefore, it is desirable to construct the circuit switching device such that a plug body provided with short-circuiting terminals inside can be completely separated from the circuit housing.

In the above circuit switching device, since a handle such as a lever is not provided to the cover 7, an operation for opening or closing is difficult. In the meantime, if a lever is protruded from the cover 7, it becomes an obstacle in an electric automobile and others the space of which is limited. Even if a lever folded by turning, is provided, if pushing force or tensile force by the lever does not operate on the fitting center of a terminal, there occurs a problem that a moment is generated, the operating force is decreased, distortion is caused between the terminals to be fitted, and operability is deteriorated.

SUMMARY OF THE INVENTION

The present invention is made in view of the above situation and an object is to provide a terminal fitting structure which can realize the satisfactory operability of a plug body in fitting or detaching in a circuit switching device (service plug) in which a lever folded by turning and housed is provided and the plug body can be detached from a circuit housing.

The terminal fitting structure of a service plug according to the present invention for achieving the above object is characterized by comprising a plug body provided with short-circuiting terminals, a turning shaft provided to the plug body so that the turning shaft is perpendicular to the respective fitting centers of the short-circuiting terminals, and a lever rotatably coupled to the plug body via the turning shaft.

In the terminal fitting structure of the service plug constituted as described above, since the center of the lever is aligned in the same straight line as the respective fitting centers of the short-circuiting terminals if the lever is stood when the plug body is attached or detached, the whole pushing force or tensile force by the lever directly operates as force for fitting or detaching the short-circuiting terminals, no moment is generated, and no part with high strength which can withstand the moment is also required, and the small-sized plug body can be realized.

BRIEF DESCRIPTION OF THE DRAWINGS

FIG. 1 is a side view of a detachable plug showing a terminal fitting structure according to the present invention;

FIG. 2 is a sectional view when the fitting of a service plug provided with the terminal fitting structure shown in FIG. 1 is started;

DETAILED DESCRIPTION OF THE INVENTION

Figure 3:
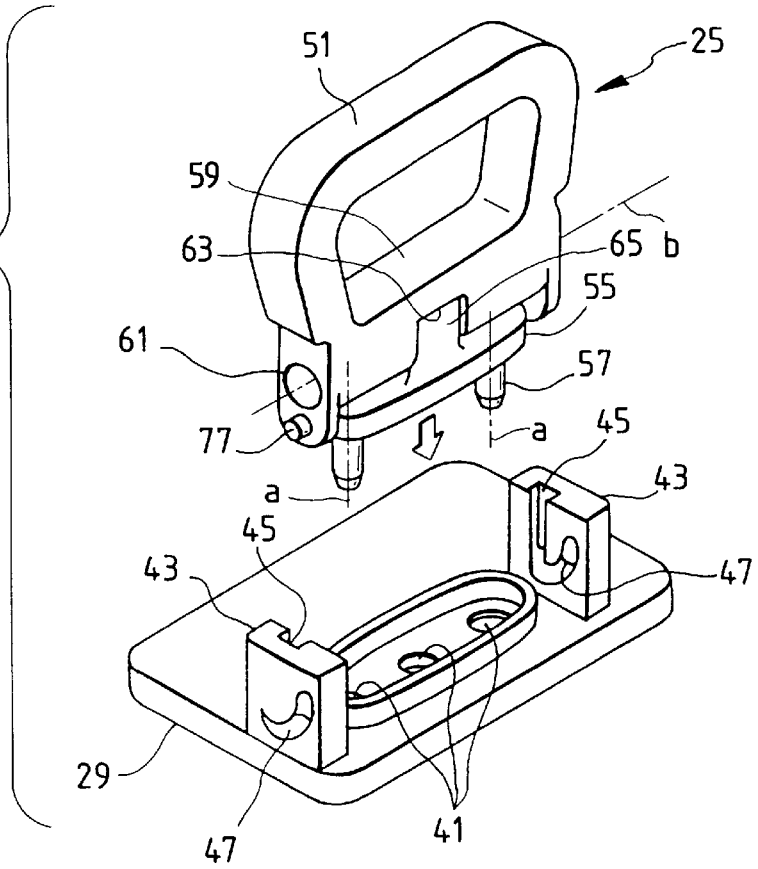
FIG. 3 is a perspective view showing a state of the detachable plug of the service plug shown in FIG. 2 before it is fitted.

Referring to the drawings, preferred embodiments of a terminal fitting structure according to the present invention will be described in detail below.

Figure 4:
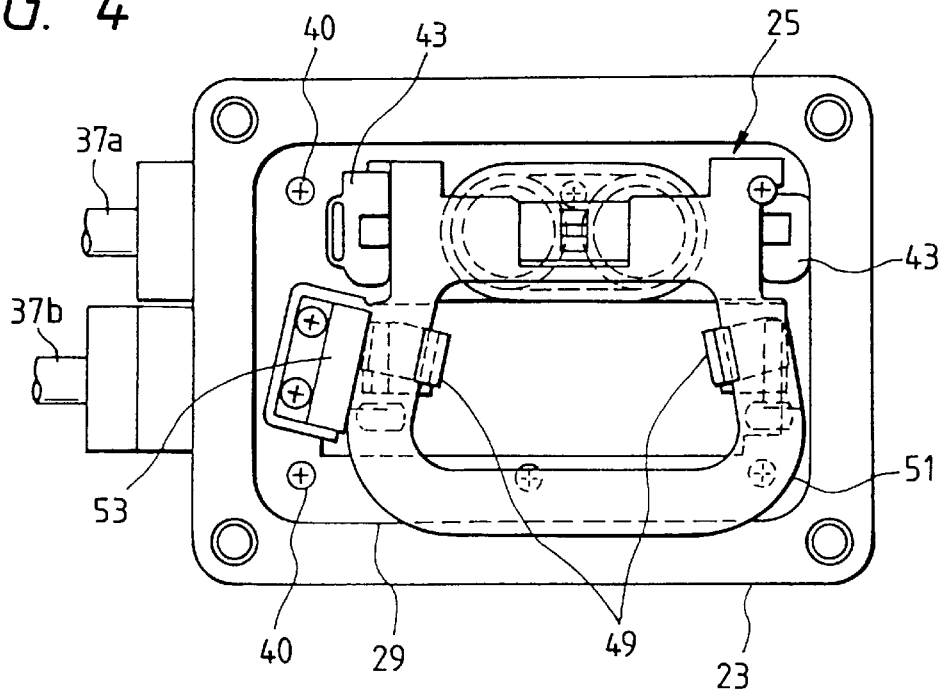
FIG. 4 is a plan view showing a state in which the lever of the service plug shown in FIG. 2 is pushed down.
Figure 5:
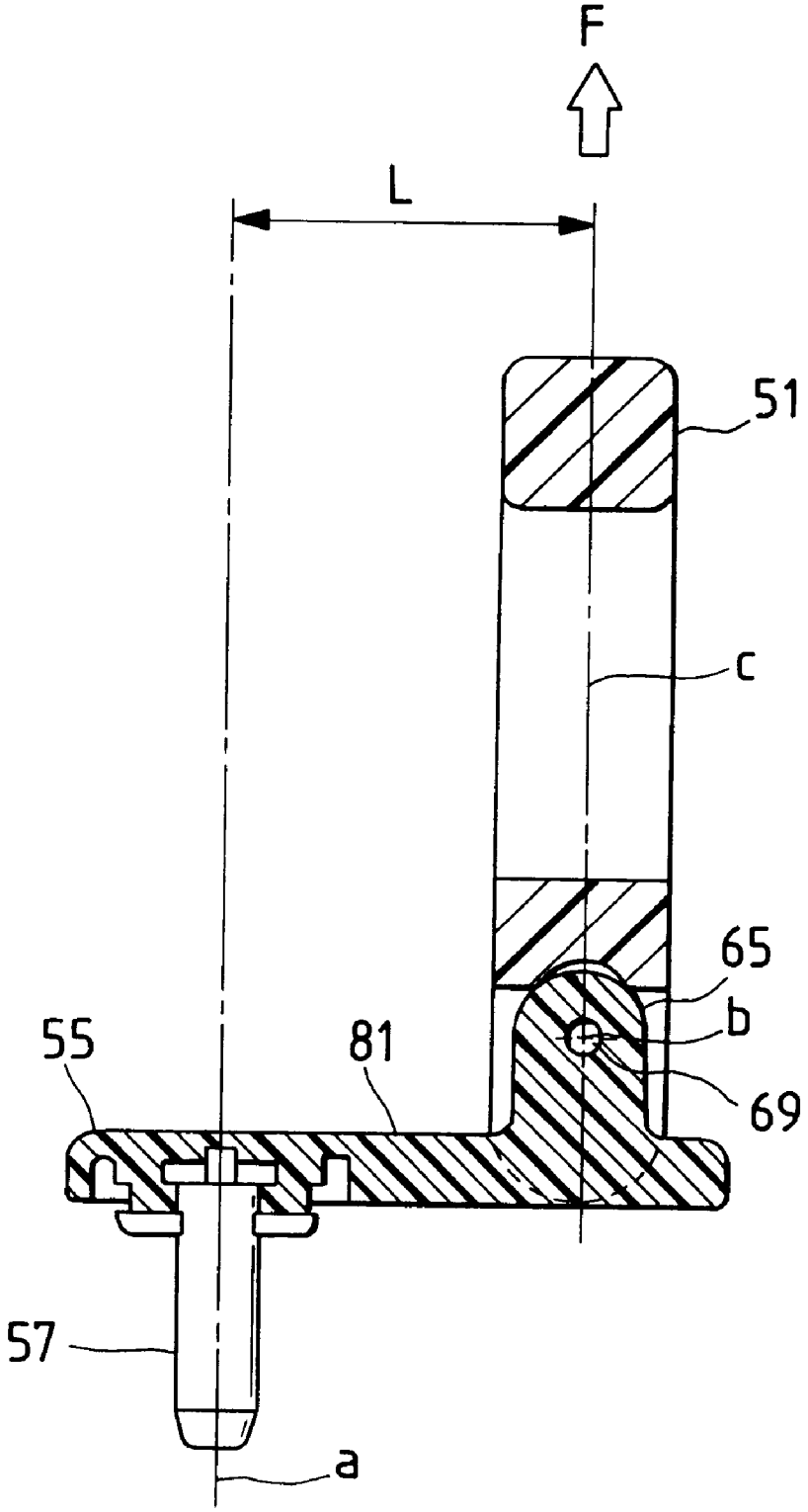
FIG. 5 is an explanatory view showing a comparison example of terminal fitting structure in which operating force is decreased.
Figure 6:
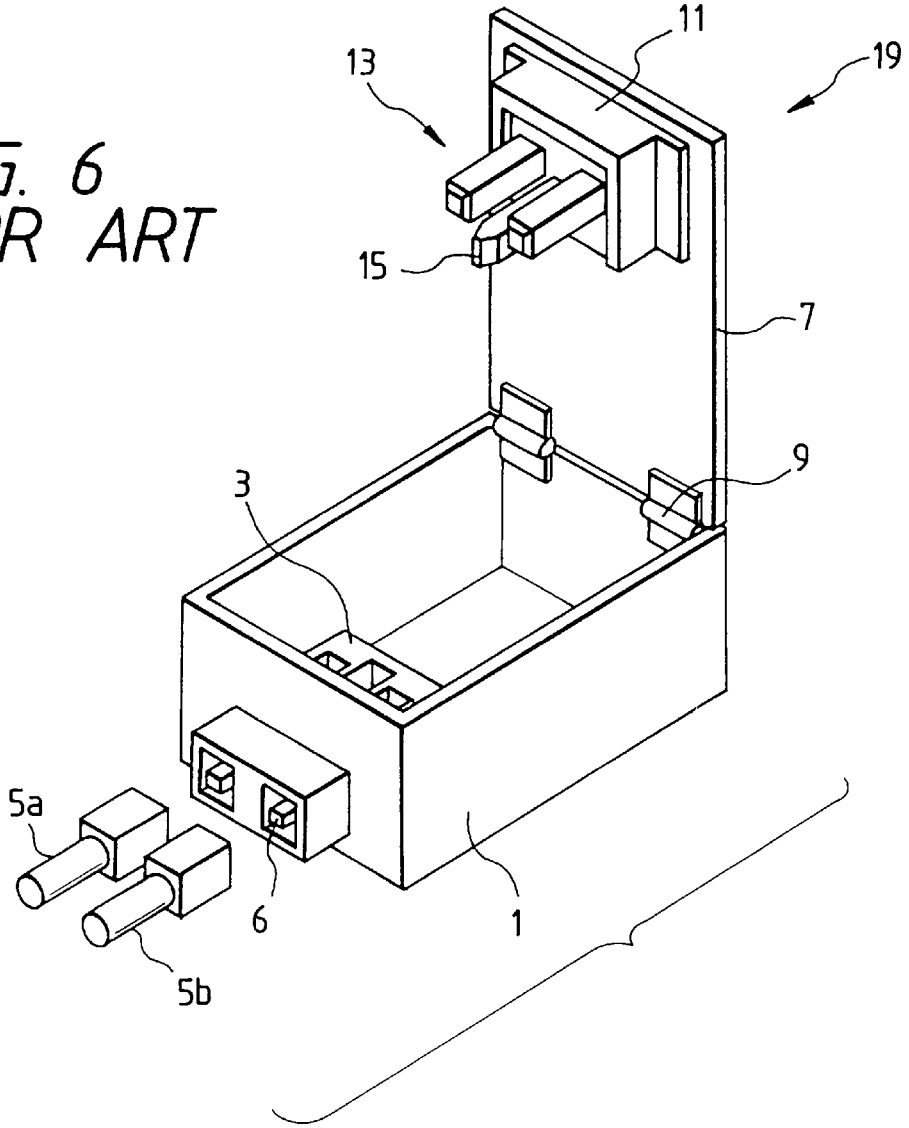
FIG. 6 PRIOR ART
FIG. 6 is a perspective view showing a conventional connector device.
Figure 7:
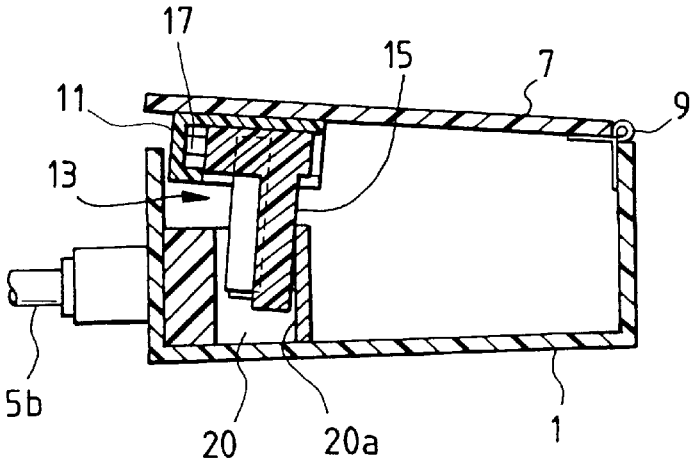
FIG. 7 PRIOR ART
FIG. 7 is a sectional view showing a process in which the cover of the conventional connector device is shut.

FIG. 1 is a side view of a detachable plug showing a terminal fitting structure according to the present invention, FIG. 2 is a sectional view of a service plug provided with the terminal fitting structure shown in FIG. 1 showing when fitting is started, FIG. 3 is a perspective view showing a state before the detachable plug of the service plug shown in FIG. 2 is fitted, FIG. 4 is a plan view showing a state in which the lever of the service plug shown in FIG. 2 is pushed down, and FIG. 5 is an explanatory view showing a comparison example of terminal fitting structure in which operating force is decreased.

As shown in FIG. 2, a service plug 21 which is a circuit switching device, comprises a circuit housing 23 and a detachable plug 25 which can be attached to and detached from the circuit housing 23. The circuit housing 23 comprises a box part 27 the upper part of which is open and a cover 29 for closing the opening of the box part 27. Plural female terminals 31 (in this embodiment, two) each of which is a cylindrical circuit terminal are provided in a row in the box part 27, and the fitting direction of each female terminal 31 is vertical (top and bottom direction in FIG. 2). High-voltage cables 37*a* and 37*b* are respectively electrically connected to the female terminals 31 via a terminal 33 or a bus bar 35, and are led outside while a rubber stopper 39 provides water sealing between the cables and the box part 27.

The cover 29 is attached to the upper opening of the box part 27 by a screw 40. Terminal inserting holes 41 (FIG. 3) corresponding to the female terminals 31 are provided on the cover 29, and the center of each terminal inserting hole 41 coincides with the fitting center of each female terminal 31. A pair of parallel guide walls 43 are provided on both sides in the direction in which the terminal inserting holes 41 are arranged in line on the upper surface of the cover 29. As shown in FIG. 3, a guide groove 45 the upper end of which is open on the upper end face of each guide wall 43 and longer vertically, is formed on the respective opposite surfaces of the guide walls 43. A refuge hole 47 in the form of an arc is linked in the lower part of the guide groove 45. The refuge hole 47 may be a groove in an arc which does not pierce each guide wall 43.

As shown in FIG. 4, a lever lock 49 is provided on the cover 29 to hold a lever 51, described later, of the detachable plug 25 on the cover 29 with the lever 51 folded. A limit switch 53 is provided to the cover 29 to open or close a switch contact by magnetic force.

In the meantime, as shown in FIG. 3, the detachable plug 25 comprises the above lever 51 formed in the shape of a rectangular frame for example, the plug body 55 rotatably coupled to the above lever 51, and male terminals 57 which are short-circuiting terminals protruded from the plug body 55. One side of the rectangular frame-shaped lever 51 is a coupling joint 59, and a through turning shaft inserting hole 61 is made in both sides of the coupling joint 59. A coupling concave portion 63 which divides the turning shaft inserting hole 61 into two parts and is cut out, is formed in the center of the coupling joint 59.

A coupling convex portion 65 for fitting into the above coupling concave portion 63 is protruded from the plug body 55, and a turning shaft inserting hole 67 shown in FIG. 2 is made through both sides of the coupling convex portion 65. The lever 51 and the plug body 55 are coupled by fitting the coupling convex portion 65 into the coupling concave portion 63 and inserting a turning shaft 69 into the turning shaft inserting holes 61 and 67 so that the lever can be turned.

The above plural (two in this embodiment) male terminals 57 are protruded from the surface of the plug body 55 on the reverse side of the coupling convex portion 65. The male terminals 57 are arranged so that fitting central axes "a" are parallel on the same plane. The above turning shaft 69 is arranged in the direction in which the center "b" of turning is perpendicular to the respective fitting centers "a" of the male terminals 57 (in the direction in which the turning shaft vertically crosses the extended axes of the male terminals). That is, when the lever 51 is stood as shown in FIG. 1, the respective fitting centers "a" of the male terminals 57, the center "b" of the turning of the turning shaft 69, and the center "c" of the lever 51 are aligned in the same line when viewed from the side of the lever 51.

An interval between both male terminals 57 is set so that it is equal to an interval between the terminal inserting holes 41. A bus bar 75 shown in FIG. 2 is provided inside the plug body 55 to conduct between the two male terminals 57. That is, the detachable plug 25 is fitted into the female terminals 31 by respectively inserting the male terminals 57 into the terminal inserting holes 41 so that the female terminals 31 can be short-circuited.

Bosses 77 are protruded from the side of the coupling joint 59 of the lever 51 in the same direction as the turning shaft 69. The bosses 77 are arranged between the turning shaft 69 and the protruded side of the male terminals 57. Each diameter and each protruded length of the bosses 77 are set so that they are fitted into the respective guide grooves 45 of the above guide walls 43. The dimensions of the bosses 77 and the male terminals 57 are set in the relative positional relationship in which each end of the male terminals 57 is inserted into each terminal inserting hole 41 immediately after the bosses 77 are respectively inserted into the guide grooves 45.

A magnet 79 shown in FIG. 2 is provided inside the lever 51 and arranged so that the magnet is opposite to the limit switch 53 with the lever 51 folded and held by the lever lock 49.

The operation of the service plug 21 constituted as described above will be described below.

In the service plug 21, the male terminals 57 respectively short-circuit the female terminals 31 and a high-voltage current circuit is closed when the detachable plug 25 is inserted into the circuit housing 23. In a state in which the detachable plug is inserted, the lever 51 is folded with the turning shaft 69 as the center as shown in FIG. 4, and held on the upper surface of the cover 29 by the lever lock 49. In this state, the limit switch 53 provided on the cover 29 is opposite to the magnet 79 of the lever 51, a contact is operated by the magnetic force of the magnet 79, and the limit switch detects that the lever 51 is in a held state.

To detach the detachable plug 25, the lever lock 49 is released and the lever 51 is stood. Hereby, the magnet 79 of the lever 51 is separated from the limit switch 53 and the limit switch 53 detects that the held state of the lever 51 is released.

Next, the male terminals 57 are respectively pulled out from the female terminals 31 by gripping the lever 51 and pulling out it from the circuit housing 23 in the direction in which the lever is separated.

At this time, in a terminal fitting structure in which the center "b" of turning is only perpendicular to the fitting direction (an arbitrary direction in which the center "a" of fitting is moved in parallel) of the male terminals 57 and the center "b" of turning is not perpendicular to the center "a" of fitting as shown in FIG. 5 for example, when the center "a" of fitting and the center "c" of the lever 51 are off by distance L, the moment is generated, operating force F is decreased, operability is deteriorated, strength which can hold force equivalent to "operating force F×distance L" is required to be provided to the part of an arm 81, and as a result, the plug body 55 is made large.

In the meantime, in the terminal fitting structure of the service plug 21 in this embodiment, since the center "b" of turning is perpendicular to the center "a" of fitting, and the center "c" of the stood lever 51 is aligned in the same straight line as the respective fitting centers "a" of the male terminals 57, the whole tensile force F by the lever 51 directly operates as force for detaching the male terminals 57, and since the moment is not generated and the part to which large strength is to be provided (the part of the arm 81) is not required, the small-sized plug body 55 can be produced.

When the male terminals 57 are respectively detached from the female terminals 31 as described above, the detachable plug 25 opens the high-voltage circuit between the female terminals 31 and high-voltage current is cut off.

In the meantime, to insert the detachable plug 25 into the circuit housing 23, the lever 51 is gripped so that the bosses 77 on both sides of the lever are respectively inserted into the guide grooves 45 of the guide walls 43. In the detachable plug 25, immediately after the bosses 77 respectively enter the guide grooves 45, each end of the male terminals 57 is inserted into the corresponding terminal inserting hole 41. When in the detachable plug 25, the bosses 77 are respectively fitted in the guide grooves 45 and each end of the male terminals 57 is inserted into the corresponding terminal inserting hole 41, relative turning relative to the circuit housing 23 with the bosses 77 as the center is regulated and the detachable plug is held in a state in which it stands.

Next, when the lever 51 is pushed in the direction of the circuit housing, the male terminals 57 are respectively fitted in the female terminals 31 and simultaneously, the bosses 77 respectively reach the corresponding refuge hole 47. At this time, the center "c" of the stood lever 51 is also aligned in the same straight line as the respective fitting centers "a" of the male terminals 57 like the time when the lever is detached, so that the whole pushing force F by the lever 51 operates as force for respectively fitting the male terminals 57 into the female terminals 31.

When the bosses 77 respectively reach the corresponding refuge hole 47, the regulation of relative turning by the guide grooves 45 is released and the lever 51 can be turned with the turning shaft 69 as the center. Afterward, when the lever 51 is turned, the bosses 77 respectively enter the corresponding refuge hole 47 and the lever 51 is folded. The limit switch 53 is operated by the magnet 79 by holding the folded lever 51 under the lever lock 49, and the limit switch 53 again detects that the lever lock 49 holds the lever.

According to the service plug 21 as described above, since the circuit housing 23 and the plug body 55 are separately constituted, and the plug body 55 can be completely separated from the circuit housing 23, electric shock caused by shutting a cover during maintenance by mistake as in the conventional connector provided with short-circuiting terminals on a cover can be prevented.

According to the terminal fitting structure of the service plug 21, since the turning shaft 69 is arranged so that the center "b" of turning is perpendicular to the respective fitting centers "a" of the male terminals 57, and the lever 51 and the plug body 55 are coupled via the turning shaft 69, the center "c" of the lever 51 and the respective fitting centers "a" of the male terminals 57 are aligned in the same straight line, and the pushing force or the tensile force of the lever 51 can be made to operate directly as force for inserting or detaching the male terminals 57. As a result, since no operating force is decreased and no moment is also generated, operability in fitting or detaching the detachable plug 25 can be enhanced.

Since the center "c" of the lever 51 and the respective fitting centers "a" of the male terminals 57 are aligned in the same straight line, no moment is generated, the part of the arm 81 shown in FIG. 5 requiring large strength is not required to be formed, and the plug body 55 can be readily miniaturized.

As described above, according to the terminal fitting structure of the service plug according to the present invention, since the turning shaft is provided to the plug body provided with short-circuiting terminals so that the turning shaft is perpendicular to the respective fitting centers of the short-circuiting terminals and the lever is coupled to the plug body via the turning shaft so that the lever can be turned, the center of the lever is aligned in the same straight line as the respective fitting centers of the short-circuiting terminals when the lever is stood to attach-or detach the plug body. As a result, the whole pushing force or the tensile force by the lever can be made to operate directly as force for fitting or detaching the short-circuiting terminals, no moment is generated, operability in attaching or detaching the plug body can be enhanced, the part with large strength which can withstand the moment is also not required, and the plug body can be also miniaturized.

What is claimed is:

1. A terminal fitting structure of a service plug, comprising:

a plug body having short-circuiting terminals;

a turning shaft provided in said plug body so that said turning shaft is perpendicular to each fitting center of said short-circuiting terminals; and a lever coupled to said plug body via said turning shaft so that said lever can be turned; wherein a fitting center of said lever and a fitting center of said short-circuiting terminals are aligned.

2. A terminal fitting structure of a service plug, comprising:

a plug body having short-circuiting terminals;

a turning shaft provided in said plug body so that said turning shaft is perpendicular to each fitting center of said short-circuiting terminals; and a lever coupled to said plug body via said turning shaft so that said lever can be folded to a held state, in which said lever is held on a circuit circuit housing.

3. A terminal fitting structure of a service plug, as claimed in claim 1, further comprising:

a bus bar provided in said plug body which provides a conductive path between said short-circuiting terminals.

4. A terminal fitting structure of a service plug, as claimed in claim 1, further comprising:

bosses disposed on sides of said plug body which guide said terminal fitting structure during insertion into a circuit housing.

5. A terminal fitting structure of a service plug, as claimed in claim 2, further comprising:

a magnet disposed in said lever, said magnet being arranged so that said magnet is disposed opposite to a limit switch provided in a circuit housing when said lever is in said held state, thereby to detect when said lever is in said held state.

6. A terminal fitting structure of a service plug, as claimed in claim 2, wherein said short-circuiting terminals protrude from said plug body in a direction substantially aligned with a center line of said lever.

7. A service plug comprising:

a terminal fitting structure including:

a plug body having short-circuit terminals;

a turning shaft provided in said plug body, said turning shaft being perpendicular to a fitting center of said short-circuiting terminals; and a lever coupled to said plug body via said turning shaft so that said lever can be folded to a held state; and a circuit housing including:

female terminals disposed in terminal insertion holes;

electrical cables connected to said female terminals, wherein when said lever is folded to a held state on said circuit housing, said short-circuiting terminals are electrically connected to said female terminals such that the female terminals are short-circuited.

8. A service plug as claimed in claim 7, further comprising:

bosses disposed on sides of said plug body which fit into guide grooves formed in said circuit housing guide and guide said terminal fitting structure during insertion of said terminal fitting structure into said circuit housing.

* * * * *